US009044799B2

(12) United States Patent
Corder

(10) Patent No.: US 9,044,799 B2
(45) Date of Patent: Jun. 2, 2015

(54) COIL WINDING DEVICE AND METHOD OF WINDING AN ELONGATE MEMBER

(75) Inventor: Tony Corder, Durham (GB)

(73) Assignee: SMS MEER GMBH, Moenchengladbach (DE)

( * ) Notice: Subject to any disclaimer, the term of this patent is extended or adjusted under 35 U.S.C. 154(b) by 622 days.

(21) Appl. No.: 13/381,711

(22) PCT Filed: Jun. 25, 2010

(86) PCT No.: PCT/GB2010/051059
§ 371 (c)(1),
(2), (4) Date: Apr. 5, 2012

(87) PCT Pub. No.: WO2011/001167
PCT Pub. Date: Jan. 6, 2011

(65) Prior Publication Data

US 2012/0181366 A1 Jul. 19, 2012

(30) Foreign Application Priority Data

Jul. 1, 2009 (GB) ..... 0911394.5

(51) Int. Cl.
*B21C 47/04* (2006.01)
*B21C 47/32* (2006.01)
(Continued)

(52) U.S. Cl.
CPC ..... *B21C 47/326* (2013.01); *B65H 57/00* (2013.01); *B21C 47/06* (2013.01); *B21C 47/3491* (2013.01); *B65H 54/2851* (2013.01); *B65H 2701/33* (2013.01)

(58) Field of Classification Search
CPC ..... B21C 47/02; B21C 47/06; B21C 47/08; B21C 47/326; B21C 47/3491; B65H 4/80; B65H 54/2851; B65H 57/00; B65H 2701/335
USPC ..... 72/146, 148; 242/361.2
See application file for complete search history.

(56) References Cited

U.S. PATENT DOCUMENTS 4,057,202 A 11/1977 Carr, Jr.
4,202,512 A 5/1980 Nicholson, Jr.
(Continued)

FOREIGN PATENT DOCUMENTS

DE 19629600 A1 1/1998
EP 0 316 949 A2 5/1989
(Continued)

OTHER PUBLICATIONS

Schlafhorst & Co., Machine Translation of DE19629600A1, Jan. 1998, pp. 1-9.*
(Continued)

*Primary Examiner* — Teresa M Ekiert
(74) *Attorney, Agent, or Firm* — Osha Liang LLP

(57) ABSTRACT

A device for winding an elongate member into a coil includes at least one first body portion adapted to rotate about a first axis; at least one fixing device for fixing a portion of an elongate member to the at least one first body portion; and at least one force applicator for applying a force to the elongate member. The force includes first and second force components acting in perpendicular first and second directions respectively, in order to restrict movement of the elongate member in directions parallel with the first and said second directions. The first force component acts towards the first body portion to which the elongate member is fixed.

13 Claims, 9 Drawing Sheets

(51) Int. Cl.

| | |
|---|---|
| ***B65H 57/00*** | (2006.01) |
| ***B21C 47/06*** | (2006.01) |
| ***B21C 47/34*** | (2006.01) |
| ***B65H 54/28*** | (2006.01) |

(56) References Cited

U.S. PATENT DOCUMENTS

| | | | | |
|---|---|---|---|---|
| 5,002,238 | A | 3/1991 | Inhofer et al. | |
| 2008/0135662 | A1 * | 6/2008 | Chang et al. ..... | 242/160.4 |

FOREIGN PATENT DOCUMENTS

| | | | |
|---|---|---|---|
| EP | 1 293 269 | A1 | 3/2003 |
| GB | 1 498 328 | A | 1/1978 |
| GB | 1 564 142 | A | 4/1980 |
| JP | 2000-264511 | A | 9/2000 |
| JP | 2002-041647 | A | 2/2002 |
| WO | 01/63084 | A2 | 8/2001 |
| WO | 2005/097644 | A1 | 10/2005 |

OTHER PUBLICATIONS

International Preliminary Report on Patentability issued in PCT/GB2010/051059, issued on Jan. 4, 2012, 7 pages.

Written Opinion issued in PCT/GB2010/051059, mailed on Oct. 1, 2010, 6 pages.

International Search Report issued in PCT/GB2010/051059, mailed on Oct. 1, 2010, 4 pages.

* cited by examiner

COIL WINDING DEVICE AND METHOD OF WINDING AN ELONGATE MEMBER

The present invention relates to a coil winding device and relates particularly but not exclusively to a device for winding a fully annealed tube into a coil with a minimum of work hardening.

The process of annealing is commonly used on copper tubes in order to improve the properties of the tubing for use in products such as refrigeration units. With reference to FIG. 1, coils of hard copper tube stored in baskets 10 are processed through an annealing line 12 to remove any work hardening before being re-coiled around a rotating axis to form multiple layers of coils of annealed copper 14. However the process of re-coiling the copper tube after the annealing process itself introduces work hardening into the copper.

A first method of winding a fully annealed tube into a coil is illustrated in FIGS. 2*a* and 2*b* which show a set of rollers 100, the distance between which may be adjusted. A tube 102 may be wound into a coil by such rollers 100 by rolling a tube 102 between the rollers 100 when they are in a position so as to introduce a slight bend into the tube 102 as it passes between the rollers 100 as illustrated in FIG. 2*b*. The bent tube is then positioned such that as more of the tube 102 passes between the rollers 100 the bent portion of the tube 102 falls loosely onto a platform 104 which rotates about an axis 106 at a speed relative to that at which the tube 102 passes between the rollers 100. The position of one of the rollers 100 is constantly adjusted so as to alter the extent to which the tube 102 is bent such that the tube 102 forms concentric winds of varying diameter within each concentric coil on the platform 104 as it rotates.

This process however has a number of limitations. For instance the use of rollers 100 has a negative effect on the hardness of the tube 102, increasing it in proportion to the degree of bending required to achieve the diameters of each wind in a coil. Layers of coils produced using this method are loosely wound and have random spacing between each coil. The presence of overlapping winds of coils in different layers ensures that more cubic space per coil is required for packaging and transportation. Furthermore, the individual coils are more susceptible to damage during transport as the free space between the windings of each coil allows for movement and potential crushing of overlapping winds in concentric coil layers.

When using this first method of winding a tube, nitrogen gas is required to be blown through the tube in an 'upstream direction' to the apparatus performing the annealing process. Such gas is used to displace oxygen from within a tube while it is being annealed to reduce the formation of impurities on the interior surface of the tube. Typically the tube is manually coupled to a back purge system used to blow the nitrogen gas back through the tube. In this instance, the first few windings of coil will not be correctly annealed as the tube will not have been running through the annealer at the correct speed. As a result, the first few windings of the finished coil will not be to specification.

A second method of winding a tube into a coil is illustrated in FIG. 3. This figure illustrates a cylindrical drum 200 to which one end of tube 202 is fixed at a point 204. The drum 200 is then rotated about an axis 206 which causes the tube to wind around the drum 200. The drum 200 is made to move along the axis 206 about which it rotates at a speed relative to that of the rotation of the drum 200, such that each successive wind of the tube 202 about the drum 200 is translationally displaced along the axis 206 relative to the preceding wind. The windings of different coils are wound onto the drum 200 such that they are on top of each other, thereby resulting in the formation of a number of layers of coils around the drum. The drum 200 has flanges 203 which are adjustable to set the depth of the coil being produced.

This second method of winding a tube into a coil has the advantage over the first method of more tightly winding the respective layers of coils and more accurately configuring the spacing between each coil.

However the second method has the disadvantage of applying significant work hardening to the tube while winding it into a coil. This requires that a length of tubing tightly wound by the second winding method must be annealed in an oven after the winding process. However, the maximum size of the coil is determined by the size of the annealing furnace.

Preferred embodiments of the present invention seek to overcome the above disadvantages of the prior art.

According to an aspect of the present invention there is provided a device for winding an elongate member into a coil, the device comprising:

- at least one first body portion adapted to rotate about a first axis;
- fixing means for fixing a portion of an elongate member to at least one first body portion; and
- force application means for applying a force to the elongate member, the force comprising first and second force components acting in perpendicular first and second directions respectively, in order to restrict movement of the elongate member in directions parallel with the first and second directions, the first force component acting towards the first body portion to which the elongate member is fixed.

By applying a force, having perpendicular first and second force components, to a tube as it is being wound into a plurality of coils layered on top of one another, allows each individual winding in a coil to be held in place while a coil is being wound. By applying to each respective winding in a coil while it is being wound a force in the direction of the preceding winding provides the advantage of more tightly winding a coil. By applying a downward force to each winding in a coil as it is being wound prevents the windings in respective layers of coils piled on top of one another from overlapping with the windings of coils in different layers. This provides the advantage of minimizing the cubic space per coil required for packaging and transportation, and reduces susceptibility to damage during transportation of the individual coils by minimizing the free space between the windings of each coil which would otherwise allow for movement and potential crushing of overlapping winds in concentric coil layers.

The winding device of the present invention has the further advantage of being able to provide the advantages above at the same time as minimizing the work hardening on a tube while it is being wound.

In a preferred embodiment the force application means comprises a second body portion from which a plurality of bristles extend.

The bristles provide the advantage of being able to apply two perpendicular components of force to a tube while it is being wound so as to provide the advantages previously discussed.

In another preferred embodiment at least one of the first or second body portions defines a planar surface.

This provides the advantage of providing a surface onto which a tube may be easily wound and unwound, and also simplifies any devices used to transport such a wound tube.

In a further preferred embodiment at least one of the first or second body portions is adapted to move along the first axis.

This provides the advantage of quickly winding a plurality of coil layers and minimizes the length of bristles required to provide the other advantages of the present invention.

In a preferred embodiment the elongate member is wound into a coil from an inside portion of the first body portion adjacent its centre to an outside portion of the first body portion adjacent its edge.

In another preferred embodiment the elongate member is wound into a coil from an outside portion of the first body portion adjacent its edge to an inside portion of the first body portion adjacent its centre.

In a further preferred embodiment the elongate member is an elongate tube.

In a preferred embodiment, the device further comprises a guide portion from which an elongate member extends into engagement with the device.

In another preferred embodiment, the first body portion is adapted to move relative to the guide portion.

This provides the advantage of more accurately controlling the diameter of each individual winding in a coil so wound using the device of the present invention.

In a further preferred embodiment, the device further comprises an annealing portion for annealing at least a portion of an elongate member before it is wound into a coil.

This provides the advantage of minimizing the amount of work hardening of the coil once it is wound. Also by annealing a tube before it is wound into a coil allows individual portions of the tube to be separately annealed rather than annealing the entire tube at once after being wound into a coil. This provides the advantage of reducing the size of the furnace used to anneal a tube to be wound using the device of the present invention.

According to an aspect of the present invention there is provided a method of winding an elongate member into a coil, comprising the steps of:

- fixing a portion of an elongate member to a first body portion;
- rotating the first body portion about a first axis, thereby causing the elongate member to wind into a coil; and
- applying a force to the elongate member using force application means, the force comprising first and second force components acting in perpendicular first and second directions respectively, in order to restrict movement of the elongate member in directions parallel with the first and second directions, the first force component acting towards the first body portion to which the elongate member is fixed.

In a preferred method, further comprising the step of moving the first body portion and the force application means relative to one another along the first axis.

In another preferred method, the elongate member is wound into a coil from an inside portion of the first body portion adjacent its centre to an outside portion of the first body portion adjacent its edge.

In a further preferred method, the elongate member is wound into a coil from an outside portion of the first body portion adjacent its edge to an inside portion of the first body portion adjacent its centre.

In a preferred method, further comprising the step of annealing the elongate member before it is wound into a coil.

Preferred embodiments of the invention will now be described, by way of example only and not in any limitative sense, with reference to the accompanying drawings in which.

Figure 1:
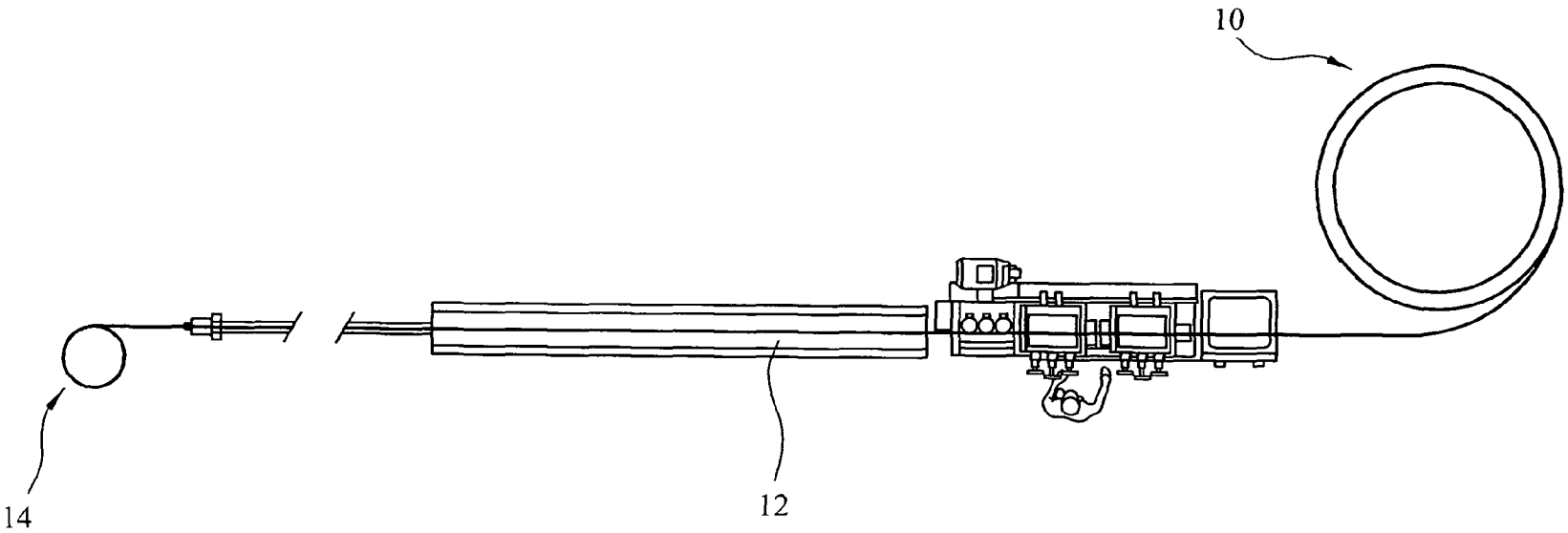
FIG. 1 PRIOR ART
FIG. 1 is a schematic representation of a coil winding process of the prior art.
Figure 2:
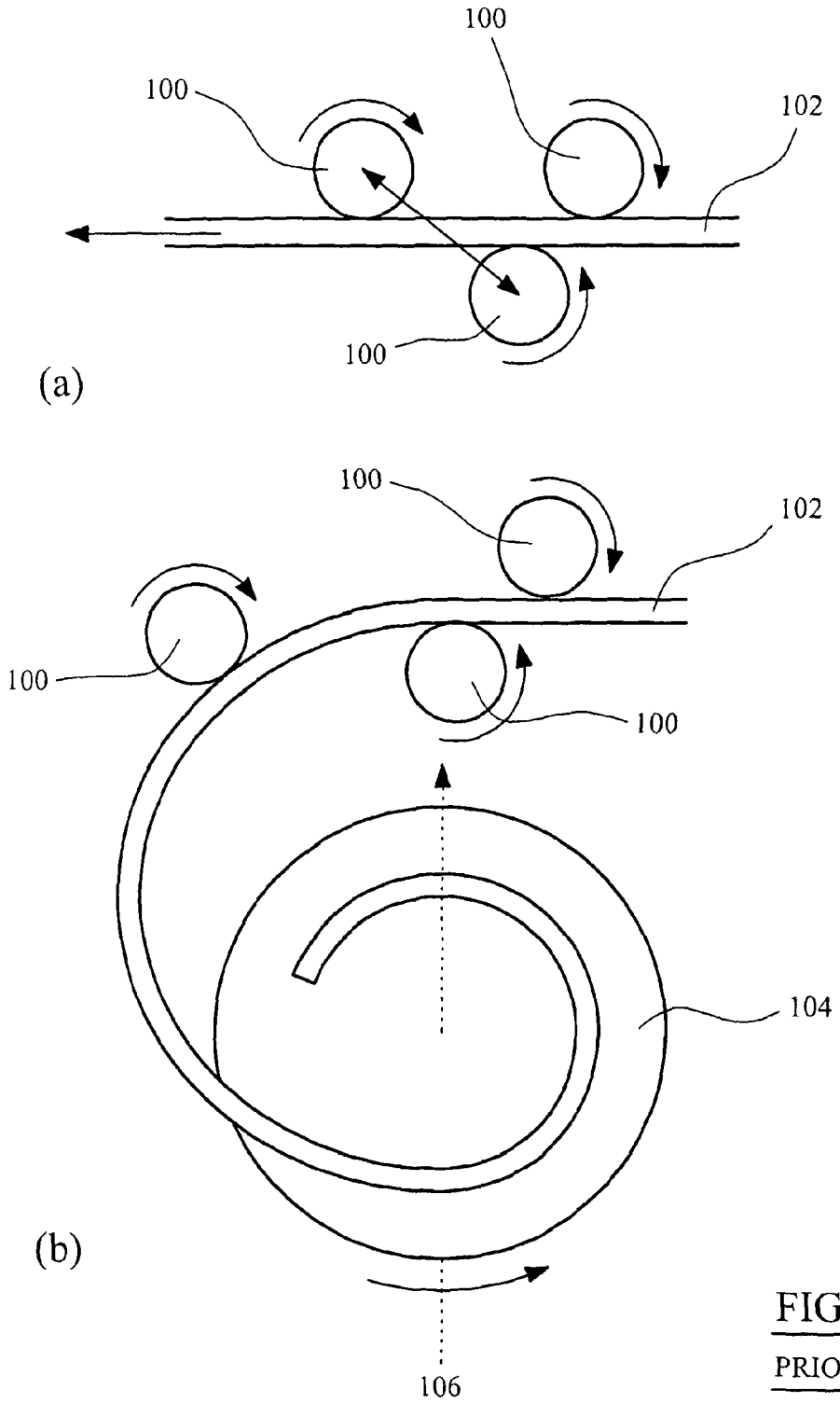
FIG. 2 PRIOR ART
FIG. 2 is a perspective view of a first coil winding device of the prior art.
Figure 3:
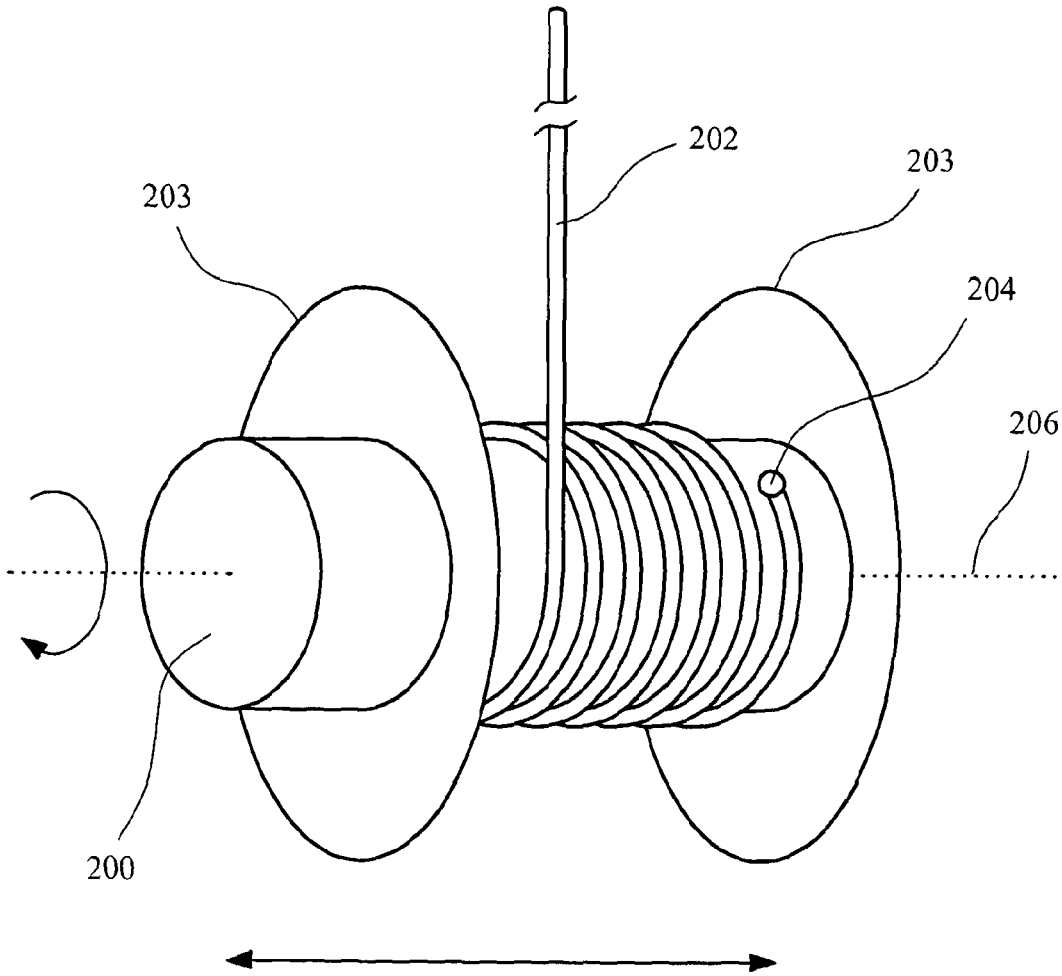
FIG. 3 PRIOR ART
FIG. 3 is a perspective view of a second coil winding device of the prior art.
Figure 4A:
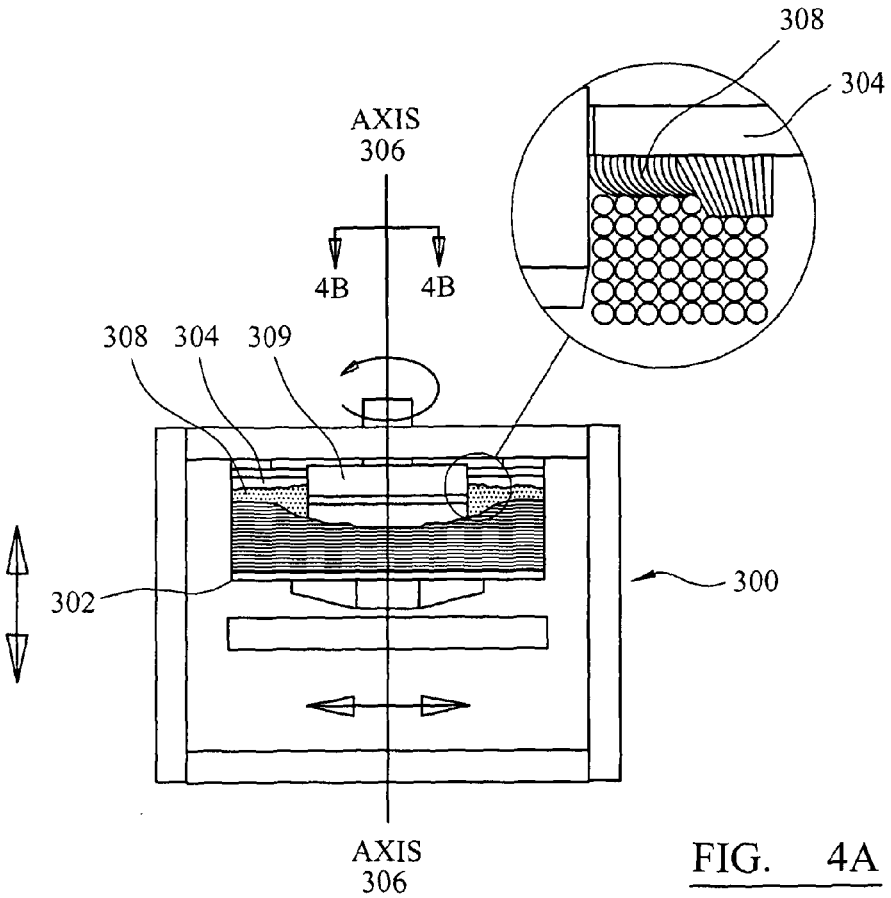
FIG. 4A is a first perspective view of a coil winding device according to the present invention.
Figure 4B:
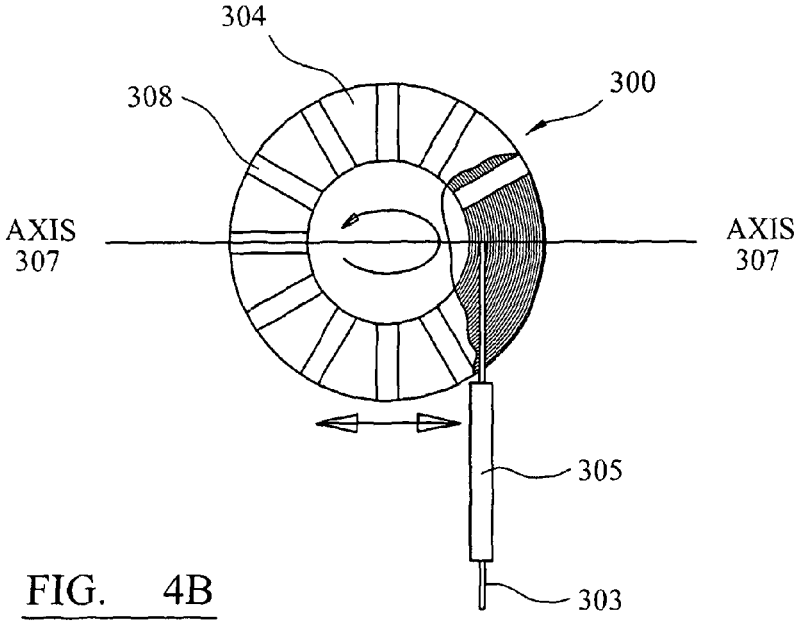
FIG. 4B is a second perspective view of the coil winding device in FIG. 4A as viewed in the direction of arrows 4B along axis 306.
Figure 4C:
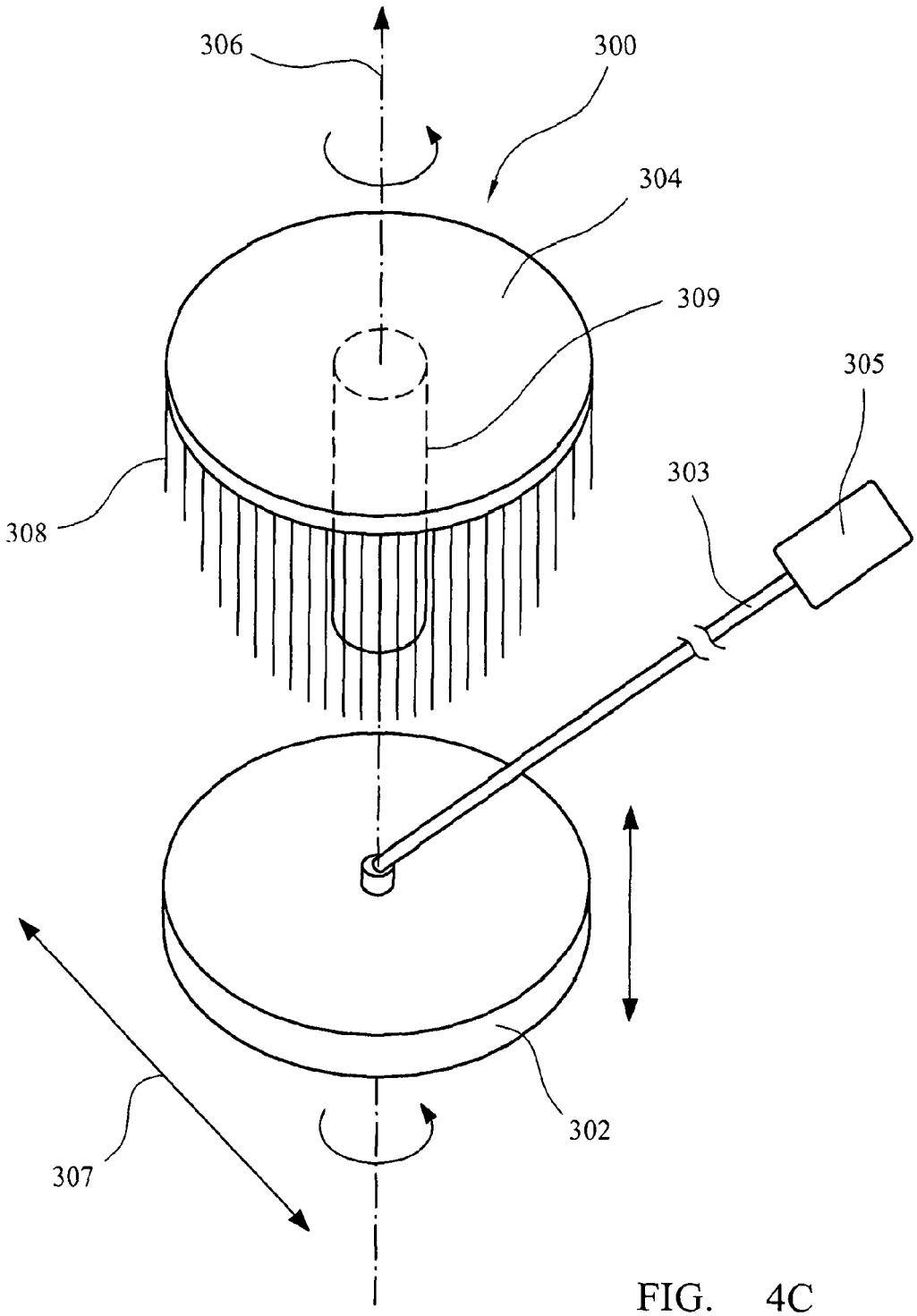
FIG. 4C is a third perspective view of the coil winding device in FIG. 4A.

Referring to FIGS. 4A, 4B and 4C, a winding device 300 is provided for winding an elongate member, for example a metal tube 303, into a coil. The winding device 300 has a first body portion 302 and a second body portion 304, which are both preferably disc shaped. The first body portion 302 is adapted to rotate about a first axis 306. The winding device 300 has fixing means for fixing a portion of a tube 303, extending from a guide member 305, to the first body portion 302. The metal tube passes through the guide member 305 and connects to the purging unit within the first body portion 302 using an automatic clamping system, see FIG. 7. The second body portion 304 has a plurality of bristles 308, and a cylindrical former member 309, extending therefrom in the direction of the first body portion 302. The bristles 308 and former member 309 preferably have a length which is approximately twice the diameter of the tube 303 that is to be wound into a coil by the device 300. The former member 309 has a diameter around which a tube can be bent without introducing an unacceptable amount of work hardening into the tube. Such a diameter may be approximately 600-700 mm which is 50 to 60 times the tube diameter.

Figure 5:
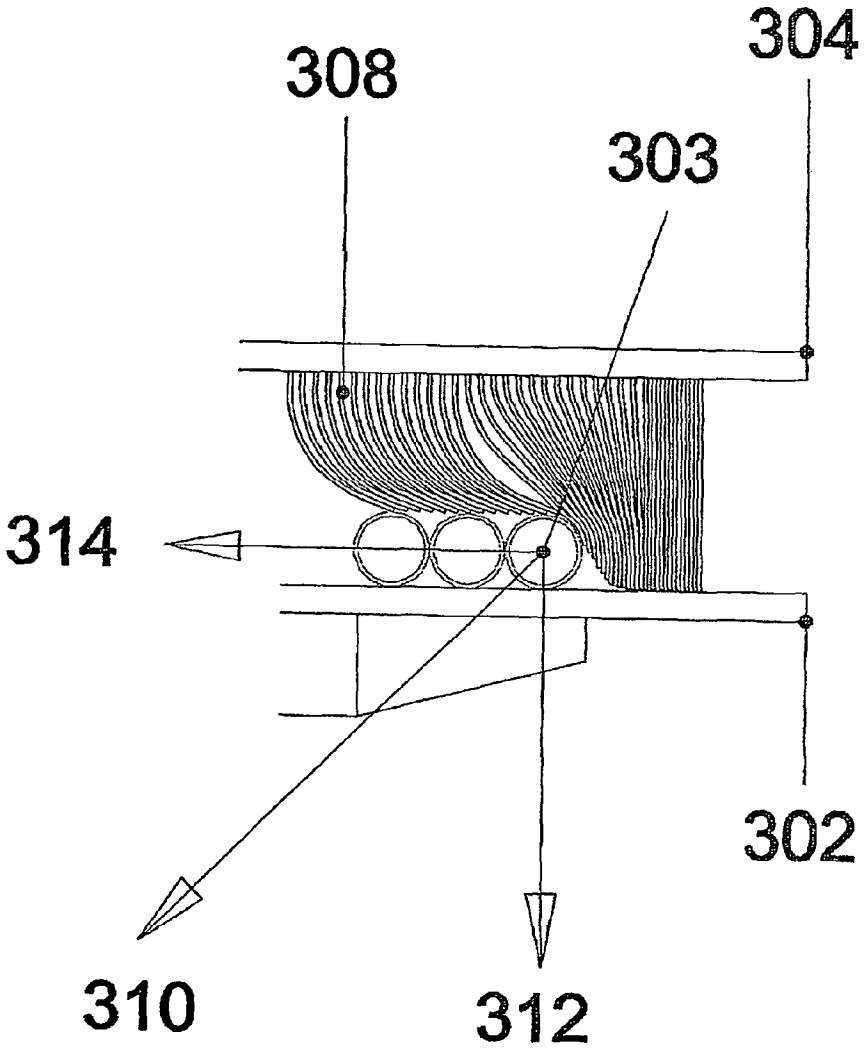
FIG. 5 is a perspective view of the bristles of the coil winding device in FIGS. 4A to 4C in engagement with the tube which is being wound.

The first body portion 302 is adapted to move along axis 306 so as to bring the bristles 308 and former member 309 into contact with the tube 303 such that the bristles 308 bend around the tube 303. Each bristle 308 bent by the tube 303 exerts a force 310 on the tube 303. A bristle 308 bent by the tube 303, as illustrated in FIG. 5, exerts a force on the tube 303 along direction 310. Such a force can be resolved into perpendicular first and second force components acting in perpendicular first and second directions 312, 314 respectively. Such components of force acting on the tube 303 therefore restrict movement of the tube 303 in directions parallel with the first and second directions 312, 314 along which the respective first and second force components of force 310 act.

The process by which the winding device 300 winds an annealed tube into a coil will now be described. Firstly an end portion of an elongate tube 303, extending from a guide member 305, is fixably attached to the first body portion 302 adjacent its centre such that it is able to be wound around the former member 309 of the second body portion 304 when brought into engagement therewith.

The bristles 308 and former member 309 of the second body portion 304 are then brought into engagement with the tube 303, such that the bristles 308 bend around it as shown in FIG. 5. The first body portion 302 is then rotated about axis 306. At the same time the first and second body portions 302, 304 are both moved, at a speed relative to that at which the first body portion 302 rotates, along a second axis 307, perpendicular to the first axis 306, thereby causing the tube 303 to wind into a first coil consisting of a number of windings of increasing diameter, the innermost winding being in engagement with the former member 309 and each successive winding being increasingly further from the centre of the first body portion 302.

When the first coil, which engages the first body portion 302, has been fully wound, i.e. windings are wound from the former member 309 to the edge of the first body portion 302, the first body portion moves away from the second body portion by a distance of one tube diameter. The first and second body portions 302, 304 then both begin to move back along the second axis 307 at the same speed they did when winding the first coil. This causes the tube 303 to wind into a second coil on top of the first coil. The second coil consists of an identical number of windings to that of the first coil, each winding of the second coil being on top of a corresponding winding in the first coil. Because during the winding of the second coil the first and second body portions 302, 304 and therefore axis 306, moves back towards their original position, the windings in the second coil are wound with ever decreasing diameter, each winding being increasingly closer to the centre of the first body portion 302, the innermost winding of which engages the former member 309 of the second body portion.

When the second coil has been wound, the first body portion 302 is moved away from the second body portion 304 along axis 306 a dimension equal to the diameter of the tube 303 being wound. A third coil is then wound, on top of the second coil, with windings of increasing diameter, the innermost of which is in engagement with the former member and the outermost of which is adjacent the edge of the first body portion. The first body portion 302 is then again moved away from the second body portion 304 along axis 306 a dimension equal to the diameter of the tube 303 being wound. A forth coil with windings of ever decreasing diameter is then wound, on top of the third coil, the innermost winding of which engages the former member 309. This winding process is then repeated, moving the first body portion 302 along axis 306 relative to the second body portion 304 a dimension equal to the diameter of the tube 303 being wound after the winding of each successive coil, until the required number of coil layers has been built up on top of each other.

When the tube 303 has been wound into the required number of coil layers the tube 303 is removed from the guide member 305 and the bristles 308 and former member 309 of the second body portion 304 are disengaged from the coils wound around the first body portion 302 which is subsequently removed from the device 300.

Figure 6A:
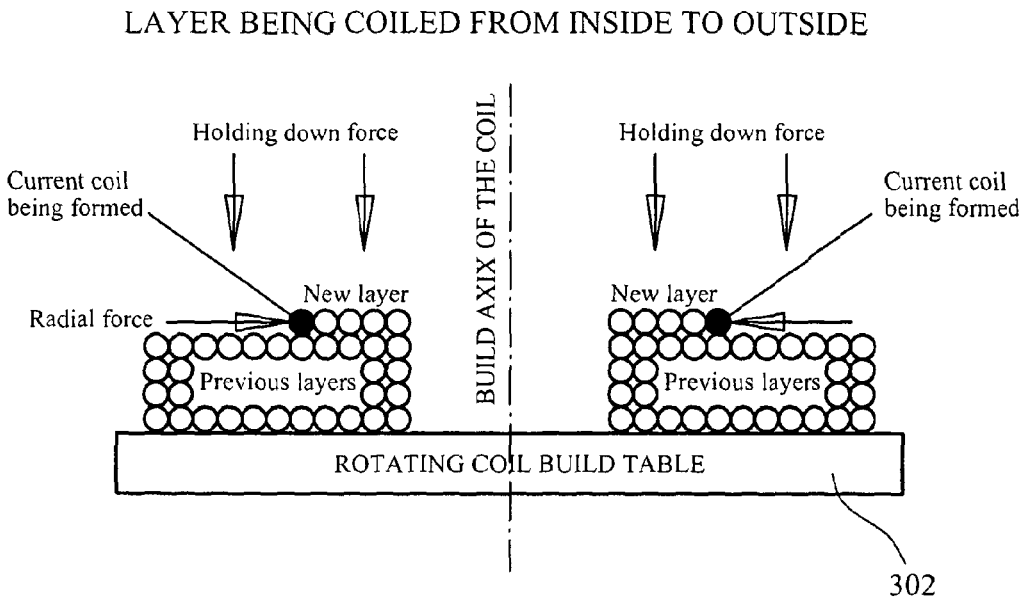
FIG. 6 is a schematic representation of the forces which act on a tube while it is being wound using the coil winding device in FIGS. 4A to 4C.

The influence of the bristles 308 on a coil being wound from an inner portion of the first body portion 302 adjacent its centre to an outer portion of the first body portion 302 adjacent its edge, is illustrated in FIG. 6*a*. The bristles 308 being bent by the tube 303 being wound into a coil exert two components of a force on the tube 303. One such component of force acts on the tube 303 in a direction towards the first body portion 302 thereby minimizing the distance between different coil layers in the pile of coil layers created by the device 300. Furthermore, a second component of force acts on the tube 303 along a direction perpendicular to the first body portion 302 towards the centre of the first body portion which pushes the respective windings in each coil together as they are being wound such that the coils are wound more tightly.

Figure 6B:
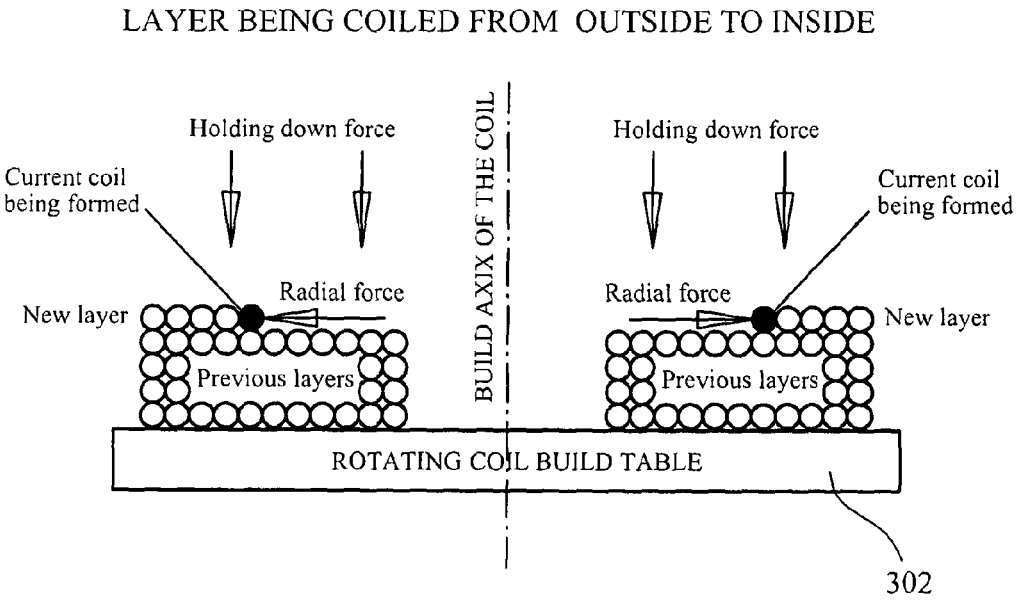

The corresponding situation to that illustrated in FIG. 6*a* i.e. the influence of the bristles 308 on a coil being wound from an outer portion of the first body portion 302 adjacent its edge to an inner portion of the first body portion 302 adjacent its centre, is illustrated in FIG. 6*b*. The bristles 308 being bent by the tube 303 being wound into a coil exert two components of a force on the tube 303. One such component of force acts on the tube 303 in a direction towards the first body portion 302 thereby reducing the distance between different coil layers in the pile of coil layers created by the device 300. Furthermore, a second component of force acts on the tube 303 along a direction perpendicular to the first body portion 302 away from the centre of the first body portion which pushes the respective windings in each coil together as they are being wound such that the coils are wound more tightly.

The tube 303 is passed through an annealing device (not shown) before it is wound into a coil using the device 300. Because of this an inert gas such as nitrogen is blown through the tube 303, using a back purge system (not shown), while using the winding device 300 of the present invention. In the winding device 300, a tube 303 is automatically connected to the back purge system using an automatic clamping system, see FIG. 7. In this instance, if the winding process must be stopped because tube 303 is not being annealed to specification upstream of the winding device 303, the tube in the system between the annealer and the winding device 300 which is not to specification is removed from the system and disposed of such that it will not become part of the finished coil.

Figure 7:
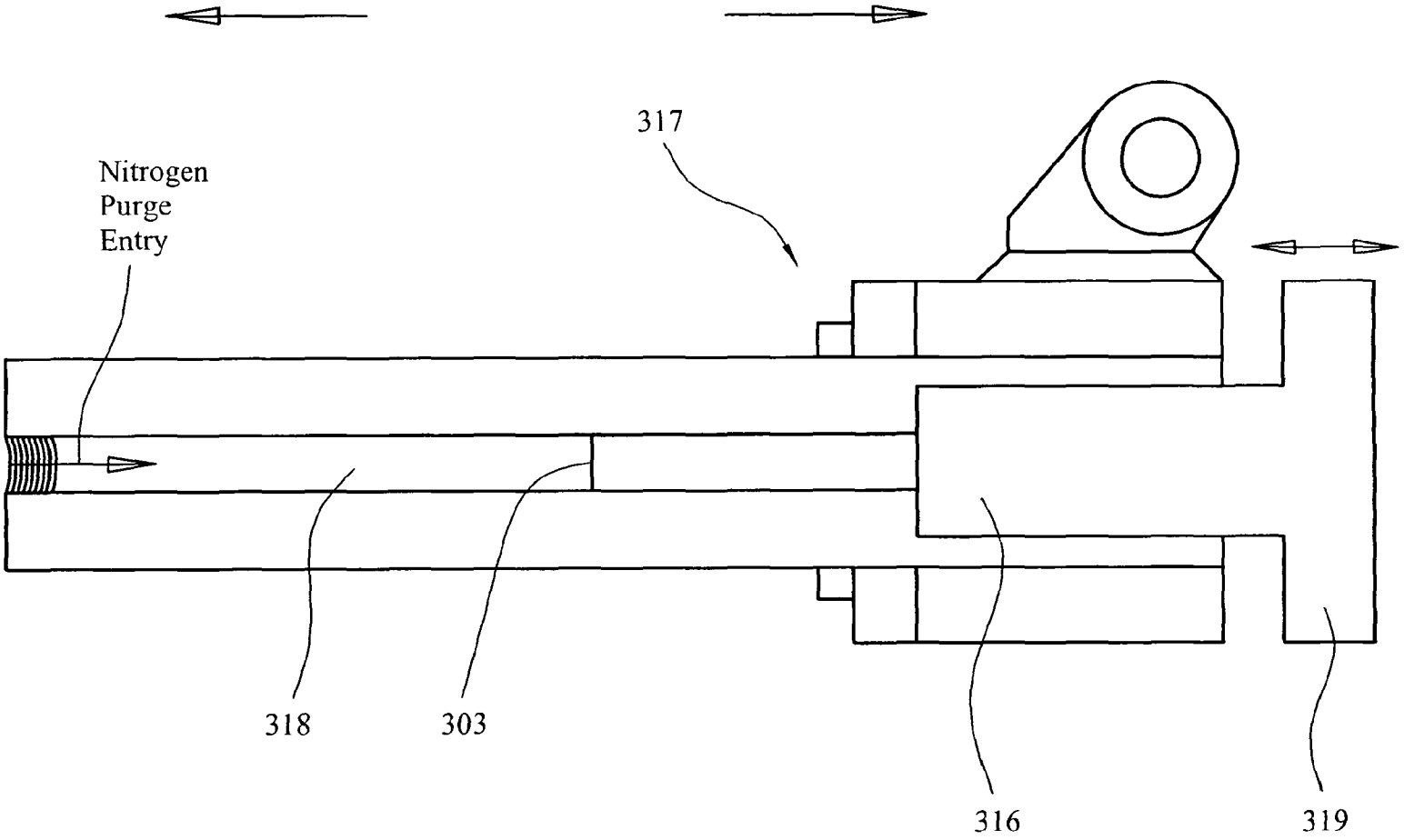
FIG. 7 is a perspective view of an automatic clamping system used to clamp a tube to be wound to the coil winding device in FIGS. 4A to 4C.

The operation of the automatic clamping system in FIG. 7 shall now be described. The clamping system 317 is mounted to the first body portion 302 and has a chamber 318 into which an inert gas is blown. A tube 303 being wound by the winding device 300, must before being wound, be first clamped in a position using the clamp 316 such that the end of the tube 303 extends into the chamber 318 so as to allow inert gas to be blown into the tube 303. For this to occur the tube 303 exiting the guide 305 enters the clamping system 317 by passing through the guide and clamp actuator 319, and clamping element 316, such that the end of the tube extends within chamber 318. The guide and clamp actuator 319 is moved towards the clamping element 316 which clamps and seals the tube 303 before nitrogen back purging is initiated. The tube stays clamped throughout the winding process, which has been previously described, thereby enabling the complete length of tube 303 to be continuously back purged. At the end of the winding process the guide and clamp actuator 319 is moved away from the clamping element 316 which releases the tube 303.

Figure 8:
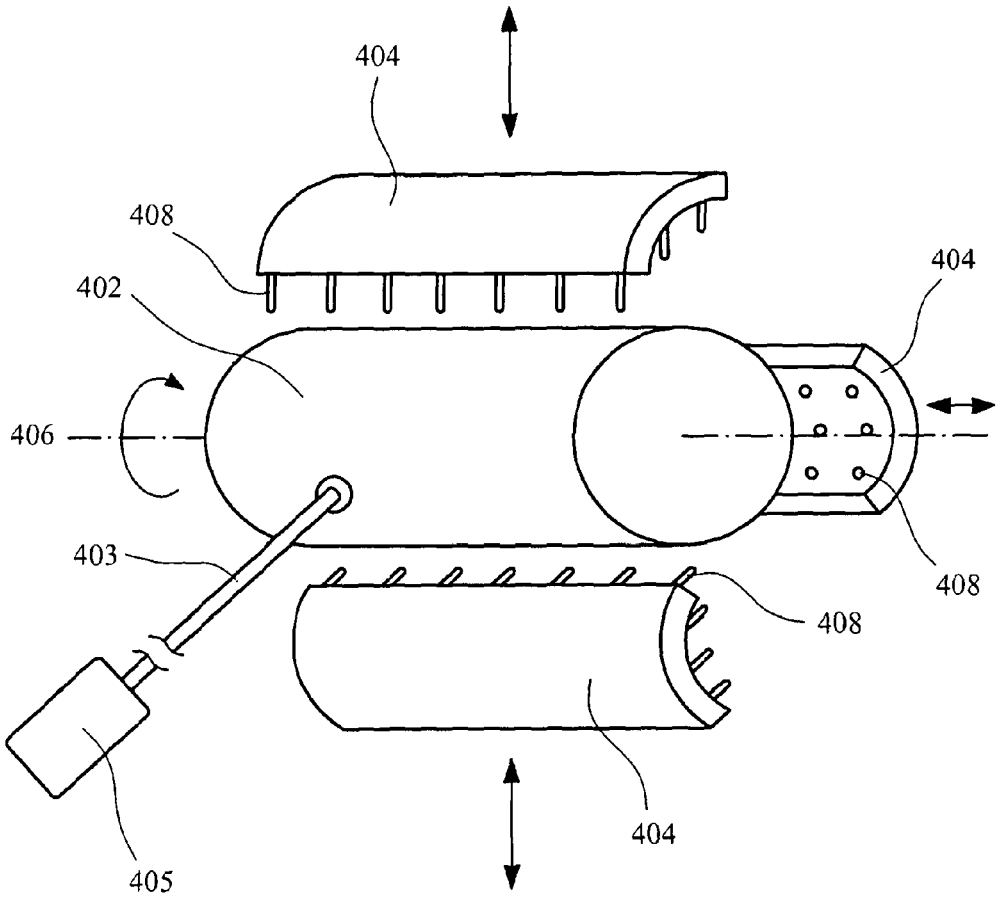
FIG. 8 is a perspective view of an adaptation of the coil winding device of the present invention.

It will be appreciated by persons skilled in the art that the above embodiments have been described by way of example only and not in any limitative sense, and that various alterations and modifications are possible without departure from the scope of the invention as defined by the appended claims. For example, the winding device 300 may be used to wind elongate members not made from metal into a coil e.g. plastic. The winding device 300 may be able to rotate, and thereby wind a coil, in both clockwise and anti-clockwise directions. It is possible that, with all of the advantages previously discussed, an adaptation of the present invention would be able to wind a tube into a coil about a cylindrical body. Such an adaptation is illustrated in FIG. 8, wherein parts similar to those in FIGS. 4A to 4C are labelled with like reference numerals increased by 100.

The invention claimed is:

1. A device for winding an elongate member into a coil, the device comprising:

at least one first body portion defining a planar surface and being adapted to rotate about a first axis;

a guide portion from which the elongate member extends into engagement with said device, wherein said first body portion is adapted to move relative to said guide portion;

at least one fixing device for fixing a portion of the elongate member to at least one said first body portion; and at least one force applicator for applying a force to said elongate member, said force comprising first and second force components acting in perpendicular first and second directions respectively, in order to restrict movement of said elongate member in directions parallel with said first and said second directions, said first force component acting towards said first body portion to which said elongate member is fixed.

2. The device of claim 1, wherein said force applicator comprises a second body portion from which a plurality of bristles extend.

3. The device of claim 2, wherein said second body portion defines a planar surface.

4. The device of claim 2, wherein at least one said first or said second body portion is adapted to move along said first axis.

5. The device of claim 1, wherein said elongate member is wound into a coil from an inside portion of said first body portion adjacent a center thereof to an outside portion of said first body portion adjacent an edge thereof.

6. The device of claim 1, wherein said elongate member is wound into a coil from an outside portion of said first body portion adjacent an edge thereof to an inside portion of said first body portion adjacent a center thereof.

7. The device of claim 1, wherein said elongate member is an elongate tube.

8. The device of claim 1, further comprising an annealing portion for annealing at least a portion of the elongate member before the elongate member is wound into a coil.

9. A method of winding an elongate member into a coil, comprising:

fixing a portion of the elongate member to a first body portion defining a planar surface;

rotating said first body portion about a first axis, thereby causing said elongate member to wind into a coil;

moving a guide portion from which said elongate member extends relative to said first body portion; and applying a force to said elongate member, the force comprising first and second force components acting in perpendicular first and second directions respectively, in order to restrict movement of said elongate member in directions parallel with said first and said second directions, said first force component acting towards said first body portion to which said elongate member is fixed.

10. The method of claim 9, further comprising moving said first body portion and a second body portion relative to one another along said first axis.

11. The method of claim 9, wherein said elongate member is wound into a coil from an inside portion of said first body portion adjacent a center thereof to an outside portion of said first body portion adjacent an edge thereof.

12. The method of claim 9, wherein said elongate member is wound into a coil from an outside portion of said first body portion adjacent an edge thereof to an inside portion of said first body portion adjacent a center thereof.

13. The method of claim 9, further comprising annealing said elongate member before the elongate member is wound into a coil.

* * * * *